US007099821B2

(12) United States Patent
Visser et al.

(10) Patent No.: US 7,099,821 B2
(45) Date of Patent: Aug. 29, 2006

(54) SEPARATION OF TARGET ACOUSTIC SIGNALS IN A MULTI-TRANSDUCER ARRANGEMENT

(75) Inventors: Erik Visser, San Diego, CA (US); Te-Won Lee, San Diego, CA (US)

(73) Assignee: Softmax, Inc., La Jolla, CA (US)

( * ) Notice: Subject to any disclaimer, the term of this patent is extended or adjusted under 35 U.S.C. 154(b) by 85 days.

(21) Appl. No.: 10/897,219

(22) Filed: Jul. 22, 2004

(65) Prior Publication Data

US 2005/0060142 A1 Mar. 17, 2005

(51) Int. Cl.
*G10L 21/02* (2006.01)

(52) U.S. Cl. ..... 704/226; 379/406.08

(58) Field of Classification Search ..... None
See application file for complete search history.

(56) References Cited

U.S. PATENT DOCUMENTS 4,649,505 A * 3/1987 Zinser, Jr. et al. ..... 379/406.08
4,912,767 A * 3/1990 Chang ..... 704/205
5,208,786 A * 5/1993 Weinstein et al. ..... 367/124
5,706,402 A * 1/1998 Bell ..... 706/22
5,732,143 A * 3/1998 Andrea et al. ..... 381/71.6
6,002,776 A * 12/1999 Bhadkamkar et al. ..... 381/66
6,108,415 A * 8/2000 Andrea ..... 379/433.03
6,381,570 B1 * 4/2002 Li et al. ..... 704/233
6,424,960 B1 * 7/2002 Lee et al. ..... 706/20
2001/0037195 A1 * 11/2001 Acero et al. ..... 704/200
2002/0110256 A1 * 8/2002 Watson et al. ..... 381/389
2002/0193130 A1 * 12/2002 Yang et al. ..... 455/501
2003/0055735 A1 * 3/2003 Cameron et al. ..... 705/26

OTHER PUBLICATIONS

Erik Visser, Te-Won Lee, "Blind source separation in mobile environments using a priori knowledge," Acoustics, Speech, and Signal Processing, 2004. Proceedings. (ICASSP '04). IEEE International Conference on, vol. 3, May 17-21, 2004, pp. iii-893-iii-896.*

Erik Visser, Te-Won Lee, "Speech enhancement using blind source separation and two-channel energy based speaker detection," Acoustics, Speech, and Signal Processing, 2003. Proceedings. (ICASSP'03). 2003 IEEE International Conference on, vol. 1, Apr. 6-10, 2003, pp. I-884-I-887.*

* cited by examiner

*Primary Examiner*—Donald L. Storm

(57) ABSTRACT

The present invention provides a process for separating a good quality information signal from a noisy acoustic environment. The separation process uses a set of at least two spaced-apart transducers to capture noise and information components. The transducer signals, which have both a noise and information component, are received into a separation process. The separation process generates one channel that is substantially only noise, and another channel that is a combination of noise and information. An identification process is used to identify which channel has the information component. The noise signal is then used to set process characteristics that are applied to the combination signal to efficiently reduce or eliminate the noise component. In this way, the noise is effectively removed from the combination signal to generate a good qualify information signal. The information signal may be, for example, a speech signal, a seismic signal, a sonar signal, or other acoustic signal.

5 Claims, 6 Drawing Sheets

SEPARATION OF TARGET ACOUSTIC SIGNALS IN A MULTI-TRANSDUCER ARRANGEMENT

RELATED APPLICATIONS

This application is related to a co-pending Patent Cooperation Treaty application number PCT/US03/39593, entitled "System and Method for Speech Processing Using Improved Independent Component Analysis", filed Dec. 11, 2003, which claims priority to U.S. patent application Nos. 60/432,691 and 60/502,253, all of which are incorporated herein by reference.

FIELD OF THE INVENTION

The present invention relates to a system and process for separating an information signal from a noisy acoustic environment. More particularly, one example of the present invention processes noisy signals from a set of microphones to generate a speech signal.

BACKGROUND

An acoustic environment is often noisy, making it difficult to reliably detect and react to a desired informational signal. In one particular example, a speech signal is generated in a noisy environment, and speech processing methods are used to separate the speech signal from the environmental noise. Such speech signal processing is important in many areas of everyday communication, since noise is almost always present in real-world conditions. Noise is defined as the combination of all signals interfering or degrading the speech signal of interest. The real world abounds from multiple noise sources, including single point noise sources, which often transgress into multiple sounds resulting in reverberation. Unless separated and isolated from background noise, it is difficult to make reliable and efficient use of the desired speech signal. Background noise may include numerous noise signals generated by the general environment, signals generated by background conversations of other people, as well as reflections and reverberation generated from each of the signals. In communication where users often talk in noisy environments, it is desirable to separate the user's speech signals from background noise. Speech communication mediums, such as cell phones, speakerphones, headsets, cordless telephones, teleconferences, CB radios, walkie-talkies, computer telephony applications, computer and automobile voice command applications and other hands-free applications, intercoms, microphone systems and so forth, can take advantage of speech signal processing to separate the desired speech signals from background noise.

Many methods have been created to separate desired sound signals from background noise signals, including simple filtering processes. Prior art noise filters identify signals with predetermined characteristics as white noise signals, and subtract such signals from the input signals. These methods, while simple and fast enough for real time processing of sound signals, are not easily adaptable to different sound environments, and can result in substantial degradation of the speech signal sought to be resolved. The predetermined assumptions of noise characteristics can be over-inclusive or under-inclusive. As a result, portions of a person's speech may be considered "noise" by these methods and therefore removed from the output speech signals, while portions of background noise such as music or conversation may be considered non-noise by these methods and therefore included in the output speech signals.

In signal processing applications, typically one or more input signals are acquired using a transducer sensor, such as a microphone. The signals provided by the sensors are mixtures of many sources. Generally, the signal sources as well as their mixture characteristics are unknown. Without knowledge of the signal sources other than the general statistical assumption of source independence, this signal processing problem is known in the art as the "blind source separation (BSS) problem". The blind separation problem is encountered in many familiar forms. For instance, it is well known that a human can focus attention on a single source of sound even in an environment that contains many such sources, a phenomenon commonly referred to as the "cocktail-party effect." Each of the source signals is delayed and attenuated in some time varying manner during transmission from source to microphone, where it is then mixed with other independently delayed and attenuated source signals, including multipath versions of itself (reverberation), which are delayed versions arriving from different directions. A person receiving all these acoustic signals may be able to listen to a particular set of sound source while filtering out or ignoring other interfering sources, including multi-path signals.

Considerable effort has been devoted in the prior art to solve the cocktail-party effect, both in physical devices and in computational simulations of such devices. Various noise mitigation techniques are currently employed, ranging from simple elimination of a signal prior to analysis to schemes for adaptive estimation of the noise spectrum that depend on a correct discrimination between speech and non-speech signals. A description of these techniques is generally characterized in U.S. Pat. No. 6,002,776 (herein incorporated by reference). In particular, U.S. Pat. No. 6,002,776 describes a scheme to separate source signals where two or more microphones are mounted in an environment that contains an equal or lesser number of distinct sound sources. Using direction-of-arrival information, a first module attempts to extract the original source signals while any residual crosstalk between the channels is removed by a second module. Such an arrangement may be effective in separating spatially localized point sources with clearly defined direction-of-arrival but fails to separate out a speech signal in a real-world spatially distributed noise environment for which no particular direction-of-arrival can be determined.

Methods, such as Independent Component Analysis ("ICA"), provide relatively accurate and flexible means for the separation of speech signals from noise sources. ICA is a technique for separating mixed source signals (components) which are presumably independent from each other. In its simplified form, independent component analysis operates an "un-mixing" matrix of weights on the mixed signals, for example multiplying the matrix with the mixed signals, to produce separated signals. The weights are assigned initial values, and then adjusted to maximize joint entropy of the signals in order to minimize information redundancy. This weight-adjusting and entropy-increasing process is repeated until the information redundancy of the signals is reduced to a minimum. Because this technique does not require information on the source of each signal, it is known as a "blind source separation" method. Blind separation problems refer to the idea of separating mixed signals that come from multiple independent sources.

Many popular ICA algorithms have been developed to optimize their performance, including a number which have evolved by significant modifications of those which only existed a decade ago. For example, the work described in A. J. Bell and T J Sejnowski, Neural Computation 7:1129–1159 (1995), and Bell, A. J. U.S. Pat. No. 5,706,402, is usually not used in its patented form. Instead, in order to optimize its performance, this algorithm has gone through several recharacterizations by a number of different entities. One such change includes the use of the "natural gradient", described in Amari, Cichocki, Yang (1996). Other popular ICA algorithms include methods that compute higher-order statistics such as cumulants (Cardoso, 1992; Comon, 1994; Hyvaerinen and Oja, 1997).

However, many known ICA algorithms are not able to effectively separate signals that have been recorded in a real environment which inherently include acoustic echoes, such as those due to room architecture related reflections. It is emphasized that the methods mentioned so far are restricted to the separation of signals resulting from a linear stationary mixture of source signals. The phenomenon resulting from the summing of direct path signals and their echoic counterparts is termed reverberation and poses a major issue in artificial speech enhancement and recognition systems. ICA algorithms may require long filters which can separate those time-delayed and echoed signals, thus precluding effective real time use.

Known ICA signal separation systems typically use a network of filters, acting as a neural network, to resolve individual signals from any number of mixed signals input into the filter network. That is, the ICA network is used to separate a set of sound signals into a more ordered set of signals, where each signal represents a particular sound source. For example, if an ICA network receives a sound signal comprising piano music and a person speaking, a two port ICA network will separate the sound into two signals: one signal having mostly piano music, and another signal having mostly speech.

Another prior technique is to separate sound based on auditory scene analysis. In this analysis, vigorous use is made of assumptions regarding the nature of the sources present. It is assumed that a sound can be decomposed into small elements such as tones and bursts, which in turn can be grouped according to attributes such as harmonicity and continuity in time. Auditory scene analysis can be performed using information from a single microphone or from several microphones. The field of auditory scene analysis has gained more attention due to -the availability of computational machine learning approaches leading to computational auditory scene analysis or CASA. Although interesting scientifically since it involves the understanding of the human auditory processing, the model assumptions and the computational techniques are still in its infancy to solve a realistic cocktail party scenario.

Other techniques for separating sounds operate by exploiting the spatial separation of their sources. Devices based on this principle vary in complexity. The simplest such devices are microphones that have highly selective, but fixed patterns of sensitivity. A directional microphone, for example, is designed to have maximum sensitivity to sounds emanating from a particular direction, and can therefore be used to enhance one audio source relative to others. Similarly, a close-talking microphone mounted near a speaker's mouth may reject some distant sources. Microphone-array processing techniques are then used to separate sources by exploiting perceived spatial separation. These techniques are not practical because sufficient suppression of a competing sound source cannot be achieved due to their assumption that at least one microphone contains only the desired signal, which is not practical in an acoustic environment.

A widely known technique for linear microphone-array processing is often referred to as "beamforming". In this method the time difference between signals due to spatial difference of microphones is used to enhance the signal. More particularly, it is likely that one of the microphones will "look" more directly at the speech source, whereas the other microphone may generate a signal that is relatively attenuated. Although some attenuation can be achieved, the beamformer cannot provide relative attenuation of frequency components whose wavelengths are larger than the array. These techniques are methods for spatial filtering to steer a beam towards a sound source and therefore putting a null at the other directions. Beamforming techniques make no assumption on the sound source but assume that the geometry between source and sensors or the sound signal itself is known for the purpose of dereverberating the signal or localizing the sound source.

Another known technique is a class of active-cancellation algorithms, which is related to sound separation. However, this technique requires a "reference signal," i.e., a signal derived from only of one of the sources. Active noise-cancellation and echo cancellation techniques make extensive use of this technique and the noise reduction is relative to the contribution of noise to a mixture by filtering a known signal that contains only the noise, and subtracting it from the mixture. This method assumes that one of the measured signals consists of one and only one source, an assumption which is not realistic in many real life settings.

Techniques for active cancellation that do not require a reference signal are called "blind" and are of primary interest in this application. They are now classified, based on the degree of realism of the underlying assumptions regarding the acoustic processes by which the unwanted signals reach the microphones. One class of blind active-cancellation techniques may be called "gain-based" or also known as "instantaneous mixing": it is presumed that the waveform produced by each source is received by the microphones simultaneously, but with varying relative gains. (Directional microphones are most often used to produce the required differences in gain.) Thus, a gain-based system attempts to cancel copies of an undesired source in different microphone signals by applying relative gains to the microphone signals and subtracting, but not applying time delays or other filtering. Numerous gain-based methods for blind active cancellation have been proposed; see Herault and Jutten (1986), Tong et al. (1991), and Molgedey and Schuster (1994). The gain-based or instantaneous mixing assumption is violated when microphones are separated in space as in most acoustic applications. A simple extension of this method is to include a time delay factor but without any other filtering, which will work under anechoic conditions. However, this simple model of acoustic propagation from the sources to the microphones is of limited use when echoes and reverberation are present. The most realistic active-cancellation techniques currently known are "convolutive": the effect of acoustic propagation from each source to each microphone is modeled as a convolutive filter. These techniques are more realistic than gain-based and delay-based techniques because they explicitly accommodate the effects of inter-microphone separation, echoes and reverberation. They are also more general since, in principle, gains and delays are special cases of convolutive filtering.

Convolutive blind cancellation techniques have been described by many researchers including Jutten et al. (1992), by Van Compernolle and Van Gerven (1992), by Platt and Faggin (1992), Bell and Sejnowski (1995), Torkkola (1996), Lee (1998) and by Parra et al. (2000). The mathematical model predominantly used in the case of multiple channel observations through an array of microphones, the multiple source models can be formulated as follows:

$$x_i(t) = \sum_{l=0}^{L} \sum_{j=1}^{m} a_{ijl}(t) s_j(t-l) + n_i(t)$$

where the x(t) denotes the observed data, s(t) is the hidden source signal, n(t) is the additive sensory noise signal and a(t) is the mixing filter. The parameter m is the number of sources, L is the convolution order and depends on the environment acoustics and t indicates the time index. The first summation is due to filtering of the sources in the environment and the second summation is due to the mixing of the different sources. Most of the work on ICA has been centered on algorithms for instantaneous mixing scenarios in which the first summation is removed and the task is to simplified to inverting a mixing matrix a. A slight modification is when assuming no reverberation, signals originating from point sources can be viewed as identical when recorded at different microphone locations except for an amplitude factor and a delay. The problem as described in the above equation is known as the multichannel blind deconvolution problem. Representative work in adaptive signal processing includes Yellin and Weinstein (1996) where higher order statistical information is used to approximate the mutual information among sensory input signals. Extensions of ICA and BSS work to convolutive mixtures include Lambert (1996), Torkkola (1997), Lee et al. (1997) and Parra et al. (2000).

ICA and BSS based algorithms for solving the multichannel blind deconvolution problem have become increasing popular due to their potential to solve the separation of acoustically mixed sources. However, there are still strong assumptions made in those algorithms that limit their applicability to realistic scenarios. One of the most incompatible assumption is the requirement of having at least as many sensors as sources to be separated. Mathematically, this assumption makes sense. However, practically speaking, the number of sources is typically changing dynamically and the sensor number needs to be fixed. In addition, having a large number of sensors is not practical in many applications. In most algorithms a statistical source signal model is adapted to ensure proper density estimation and therefore separation of a wide variety of source signals. This requirement is computationally burdensome since the adaptation of the source model needs to be done online in addition to the adaptation of the filters. Assuming statistical independence among sources is a fairly realistic assumption but the computation of mutual information is intensive and difficult. Good approximations are required for practical systems. Furthermore, no sensor noise is usually taken into account which is a valid assumption when high end microphones are used. However, simple microphones exhibit sensor noise that has to be taken care of in order for the algorithms to achieve reasonable performance. Finally most ICA formulations implicitly assume that the underlying source signals essentially originate from spatially localized point sources albeit with their respective echoes and reflections. This assumption is usually not valid for strongly diffuse or spatially distributed noise sources like wind noise emanating from many directions at comparable sound pressure levels. For these types of distributed noise scenarios, the separation achievable with ICA approaches alone is insufficient.

What is desired is a simplified speech processing method that can separate speech signals from background noise in near real-time and that does not require substantial computing power, but still produces relatively accurate results and can adapt flexibly to different environments.

SUMMARY OF THE INVENTION

Briefly, the present invention provides a process for generating an acoustically distinct information signal based on recordings in a noisy acoustic environment. The process uses a set of a least two spaced-apart transducers to capture noise and information components. The transducer signals, which have both a noise and information component, are received into a separation process. The separation process generates one channel that is dominated by noise, and another channel that is a combination of noise and information. An identification process is used to identify which channel has the information component. The noise-dominant signal is then used to set process characteristics that are applied to the combination signal to efficiently reduce or eliminate the noise component. In this way, the noise is effectively removed from the combination signal to generate a good quality information signal. The information signal may be, for example, a speech signal, a seismic signal, a sonar signal, or other acoustic signal.

In a more specific example, the separation process uses two microphones to distinguish a speaker's voice from the environmental noise component. When properly positioned, the microphones receive in different magnitudes both the speaker's voice as well as environmental noise components. The microphones may be adapted to enhance separation results by modulating the input of the two types of components, namely the desired voice and the environmental noise components, such as modulation of the gain, direction, location, and the like. The signals from the microphones are simultaneously or subsequently received in a separation process, which generates one channel that is noise dominant, and generates a second channel that is a combination of noise and speech components. The identification process is used to determine which signal is the combination signal and which has stronger speech components. The combination signal is filtered using a noise-reduction filter to identify, reduce or remove noise components. Since the noise signal is used to adapt and set the filter's coefficients, the filter is enabled to efficiently pass a particularly good quality speech signal which is audibly distinct from the noise component.

Advantageously, the present separation process enables nearly real-time signal separation using only a reasonable level of computing power, while providing a high quality information signal. Further, the separation process may be flexibly implemented in analog or digital devices, such as communication devices, and may use alternative processing algorithms and filtering topologies. In this way, the separation process is adaptable to a wide variety of devices, processes, and applications. For example, the separation process may be used in a variety of communication devices such as mobile wireless devices, portable handsets, headsets, walkie-talkies, commercial radios, car kits, and voice activated devices.

Other aspects and embodiments are illustrated in drawings, described below in the "Detailed Description" section, or defined by the scope of the claims.

DETAILED DESCRIPTION OF THE PREFERRED EMBODIMENT

Figure 1:
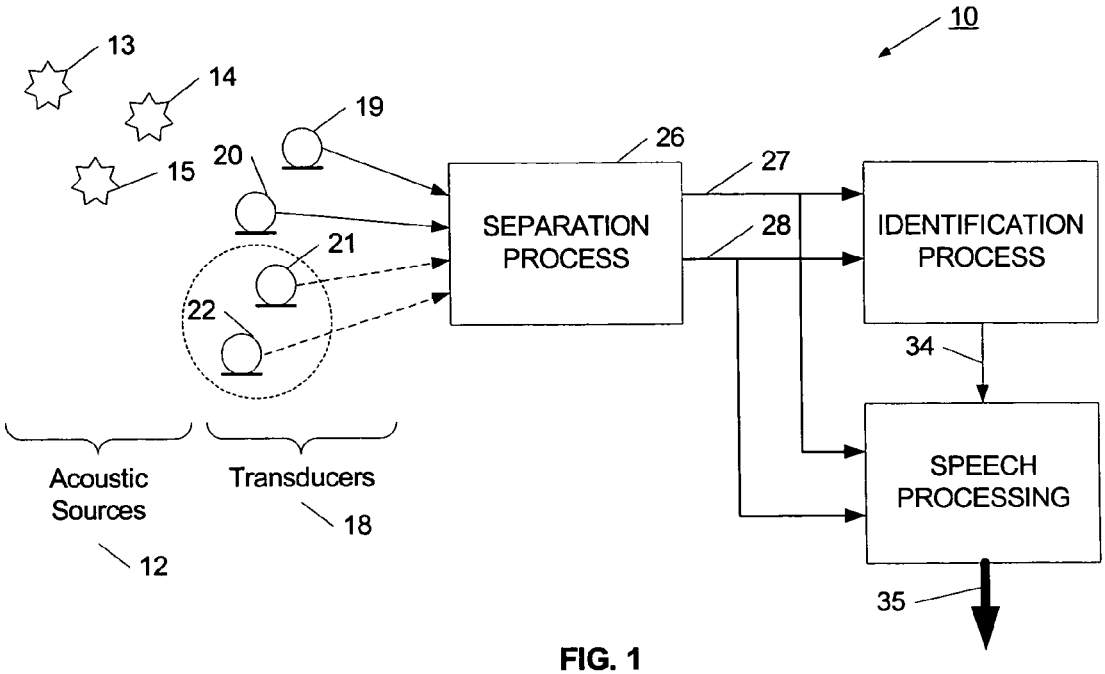
FIG. 1 is a block diagram illustrating a separation process in accordance with the present invention.

Referring now to FIG. 1, a process for separating an acoustic signal is illustrated. More particularly, separation process 10 is useful for separating or extracting a speech signal in a noisy environment. Although separation process 10 is discussed with reference to a speech information signal, it will be appreciated that other acoustic information signals may be used, for example, mechanical vibrations, seismic waves or sonar waves. Separation process 10 may be operated on a processor device, such as a microprocessor, programmable logic device, gate array, or other computing device. It will be appreciated that separation process 10 may also be implemented in one or more integrated circuit devices, or may incorporate more discrete components. It will also be understood that portions of process 10 may be implemented as software or firmware cooperating with a hardware processing device.

Separation process 10 has a set of transducers 18 arranged to respond to environmental acoustic sources 12. In one application, each transducer, for example a microphone, is positioned to capture sound produced by a speech source 14 and noise sources 13 and 15. Typically, the speech source will be a human speaking voice, while the noise sources will represent unwanted sounds, reverberations, echoes, or other sound signals, including combinations thereof. Although FIG. 1 shows only two noise sources, it is likely that many more noise sources will exist in a real acoustic environment. In this regard, it would not be unusual for the noise sources to be louder than the speech source, thereby "burying" the speech signal in the noise. In one example, a set of microphones is mounted on a portable wireless device, such as a mobile handset, and the speech source is a person speaking into the handset. Such a mobile handset may be operated in very noisy environments, where it would be highly desirable to limit the noise component transmitted to the receiving party. In this regard, the separation process 10 provides the mobile handset with a cleaner, more usable speech signal. In another example, separation process 10 is operated on a voice-activated device. In this case, one of the significant noise sources may be the operational noise of the device itself.

As defined herein, transducers are signal detection devices, and may be in the form of sound-detection devices such as microphones. Specific examples of microphones for use with embodiments of the invention include electromagnetic, electrostatic, and piezo-electric devices. The sound-detection devices may process sounds in analog form. The sounds may be converted into digital format for the processor using an analog-to-digital converter. In one example, the separation process enables a diverse range of applications in addition to speech separation, such as locating specific acoustic events using waves that are emitted when those events occur. The waves (such as sound) from the events of interest are used to determine the range of the source position from a designated point. In turn, the source position of the event of interest may be determined.

Separation process 10 uses a set of at least two spaced-apart microphones, such as microphones 19 and 20. To improve separation, it is desirable that the microphones have a direct path to the speaker's voice. In such a direct path, the speaker's voice travels directly to each microphone, without any intervening physical obstruction. The separation process 10 may have more than two microphones 21 and 22 for applications requiring more robust separation, or where placement constraints cause more microphones to be useful. For example, in some applications it may be possible that a speaker may be placed in a position where the speaker is shielded from one or more microphones. In this case, additional microphones would be used to increase the likelihood that at least two microphones would have a direct path to the speaker's voice. Each of the microphones receives acoustic energy from the speech source 14 as well as from the noise sources 13 and 15, and generates a composite signal having both speech components and noise components. Since each of the microphones is separated from every other microphone, each microphone will generate a somewhat different composite signal. For example, the relative content of noise and speech may vary, as well as the timing and delay for each sound source.

Separation process 10 may use a set of at least two spaced-apart microphones with directivity characteristics. In certain applications, it is desirable to use directional microphones where the directivity pattern can be generated in many different embodiments. In one example the directivity is due to the physical characteristic of the microphone (e.g. cardiod or noise canceling microphone). Another implementation uses the combination and processing of multiple microphones (e.g. processing of two omnidirectional microphones yields one directional microphone). In another use, the placement and physical occlusion of microphones can lead to a directivity characteristic of the microphone. The use of directivity patterns in the microphones may facilitate the separation process or void the separation process (e.g. ICA process) thus focusing on the post processing process.

The composite signal generated at each microphone is received by a separation process 26. The separation process 26 processes the received composite signals and generates a first channel 27 and a second channel 28. In one example, the separation process 26 uses an independent component analysis (ICA) process for generating the two channels 27 and 28. The ICA process filters the received composite signals using cross filters, which are preferably infinite impulse response filters with nonlinear bounded functions. The nonlinear bounded functions are nonlinear functions with pre-determined maximum and minimum values that can be computed quickly, for example a sign function that returns as output either a positive or a negative value based on the input value. Following repeated feedback of signals, two channels of output signals are produced, with one channel dominated with noise so that it consists substantially of noise components, while the other channel contains a combination of noise and speech. It will be understood that other ICA filter functions and processes may be used consistent with this disclosure. Alternatively, the present invention contemplates employing other source separation techniques. For example, the separation process could use a blind signal source (BSS) process, or an application specific adaptive filter process using some degree of a priori knowledge about the acoustic environment to accomplish substantially similar signal separation.

The separation process 26 is thereby tuned to generate a signal that is noise-dominant, and another signal that is a combination of noise and speech. In order to enable further processing, the channels 27 or 28 are identified according to whether each respective channel has the noise-dominant signal or the composite or combination signal. To do so, the separation process 10 uses an identification process 30. The identification process 30 may apply an algorithmic function to one or both of the channels to identify the channels. For example, the identification process 30 may measure distinct characteristic of the channel such as the energy or signal-to-noise ratio (SNR) in the channels, or other distinctive characteristic, and based on expected criteria, may determine which channel is noise-dominant and which is noise plus speech (combination). In another example, the identification process 30 may evaluate the zero-crossing rate characteristics of one or both channels, and based on expected criteria, may determine which channel is noise-only and which is the combination channel. In these examples, the identification process evaluates the characteristics of the channel signal(s) to identify the channels.

As used herein, the term "noise-dominant" refers to the channel having lesser magnitudes or amounts of the speech signal or alternatively, greater magnitudes or amounts of the noise signal, as compared to the noise+speech combination channel. Correspondingly, the term "noise+speech" or "combination" channel refers to the channel having greater magnitudes or amounts of the speech signal than in the noise-dominant channel. Such language should not be construed as literally referring to a channel devoid of the other signal, i.e., speech or noise. Alternatively, it is to be understood that both channels 27 and 28 will have overlapping noise and speech signals, with one containing greater speech characteristics and the other containing greater noise characteristics.

The identification process 30 may also use one or more multi-dimensional characteristics to assist in the identification process. For example, a voice recognition engine may be receiving the signal generated by the separation process 10. The identification process 30 may monitor the speech recognition accuracy that the engine achieves, and if higher recognition accuracy is measure when using one of the channels as the combination channel, then it is likely that the channel is the combination channel. Conversely, if low speech recognition is found when using one of the channels as the combination channel, then it is likely that the channels have been mis-identified, and the other channel is actually the combination channel. In another example, a voice activity detection (VAD) module may be receiving the signal generated by the separation process 10. The identification module monitors the resulting voice activity when each channel is used as the combination channel in the separation process 10. The channel that produces the most voice activity is likely the combination channel, while the channel with less voice activity is the noise-dominant channel.

In another application of the identification process 30, the identification process 30 uses a-priori information to initially identify the channels. For example, in some microphone arrangements, one of the microphones is very likely to be the closest to the speaker, while all the other microphones will be further away. Using this pre-defined position information, the identification process can pre-determine which of the channels (27 or 28) will be the combination signal, and which will be the noise-dominant signal. Using this approach has the advantage of being able to identify which is the combination channel and which is the noise-dominant channel without first having to significantly process the signals. Accordingly, this method is efficient and allows for fast channel identification, but uses a more defined microphone arrangement, so is less flexible. This method is best used in more static microphone placements, such as in headset applications. In headsets, microphone placement may be selected so that one of the microphones is nearly always the closest to the speaker's mouth to identify this microphone comprising the speech+noise signals. However, the identification process may still apply one or more of the other identification processes to assure that the channels have been properly identified.

The identification process 30 provides the speech processing module 33 a signal 34 indicating which of the channels 27 or 28 is the combination channel. The speech processing module also receives both channels 27 and 28, which are processed to generate a speech output signal 35. The speech processing module 33 uses the noise-dominant signal to process the combination signal to remove the noise components, thereby exposing the speech components. More particularly, the speech processing module 33 uses the noise-dominant signal to adapt a filter process to the combination signal. This noise reduction filter may take the form of a finite impulse filter, an infinite impulse filter, or a high, low, or band-pass filter arrangement. As the filter adapts and adjusts its coefficients, the quality of the resulting speech signal improves. Due to its adaptive nature, the separation process also efficiently responds to changes in speech or environmental conditions.

Figure 2:
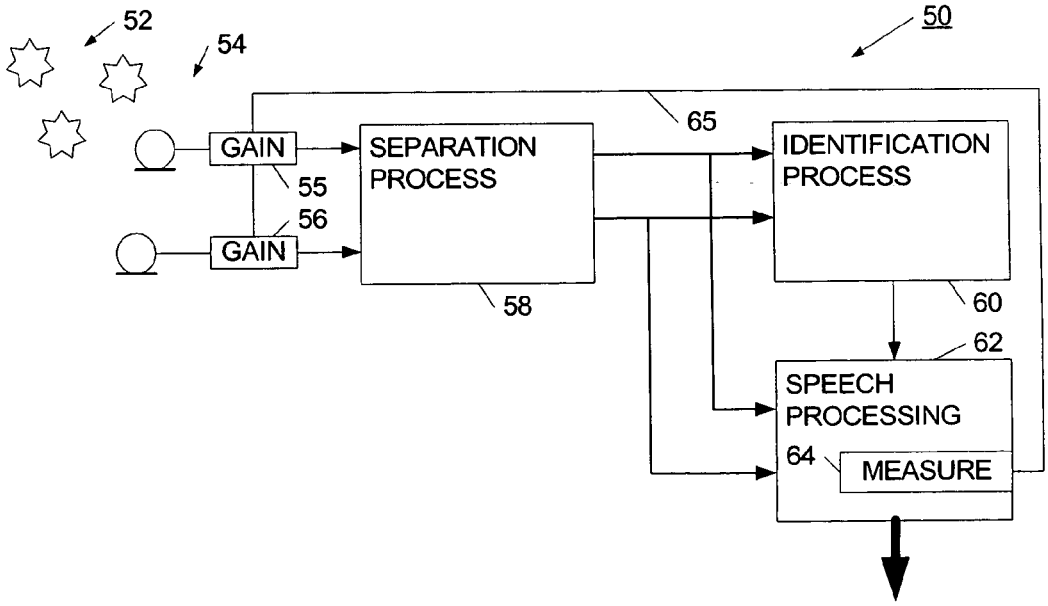
FIG. 2 is a block diagram illustrating a separation process in accordance with the present invention.

Referring now to FIG. 2, another speech separation process 50 is shown. Separation process 50 is similar to separation process 10 described with reference to FIG. 1, and therefore will not be described in detail. Separation process 50 has a set of sound sources 52 that includes a speech source and several noise sources. Two microphones 54 are positioned to receive the speech and noise sounds, and generate composite signals in response to the sounds. The gain of one of the microphones is adjusted with gain setting 55, while the gain of the other microphone is adjusted with gain setting 56. The gain settings 55 and 56 may be, for example, adjustable amplifiers, or may be a multiplication factor if operating with digital data. The amplified composite signals are received into the separation process 58, which separates the signals into two channels. The channels are identified in identification process 60 and processed in speech processing module 64 to generate a speech output signal, as discussed in detail with reference to FIG. 1.

The speech processing module 62 also has a measure module 64 which measures the level of speech component in the noise-dominant signal. Responsive to this measurement, the measure module provides an adjustment signal 65 to one or both of the gain settings 55 and 56. By adjusting the relative gain between or among the microphones, the level of the speech component in the noise-dominant signal may be substantially reduced. In this way, the noise-dominant signal may be better used in the adaptive filter of the speech processing module to more effectively remove noise from the combination signal. Adjusting the gain of the microphones is useful for improving the quality of the resulting speech output signal.

Figure 3:
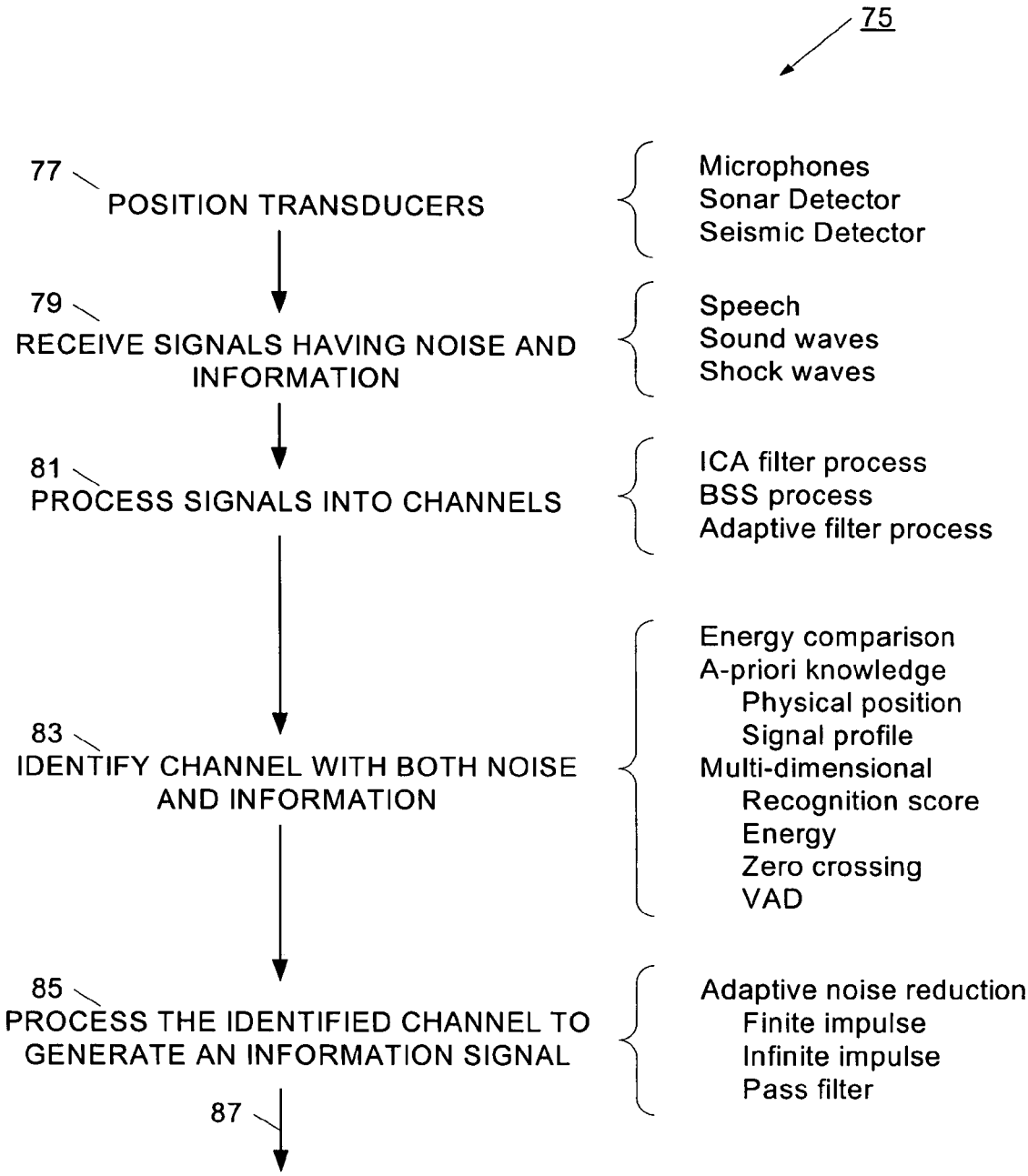
FIG. 3 is a flowchart of a separation process in accordance with the present invention.

Referring now to FIG. 3, a process for separating acoustic signals is illustrated. Process 75 is useful for separating, for example, a speech signal from a noisy environment. To use process 75, a set of transducers is first positioned to receive sounds from both an informational source and one or more noise sources as shown in block 77. The set includes at least two transducers, and may include three or more transducers to meet application specific requirements. If three or more transducers are used, it is preferable that the transducers be positioned in a non-linear arrangement. That is, superior separation may be achieved by avoiding placing the transducers in a line. The selection of transducers will depend on the specific acoustic signal of interest. For example, if the target signal is a speech signal, then the transducer may be selected as a voice grade microphone. For sonar or seismic signals, other appropriately constructed transducers may be used. As shown in block 79, each transducer produces a composite signal that has a noise component and an informational component. Again, depending on the target acoustic signal, the information component could be human speech, sonar beacons, or seismic shock waves, for example.

This signal processing problem arises in many contexts other than the simple situation where each of two mixtures of two speaking voices reaches one of two microphones. It is interesting to consider that acoustic signals are basically wave signals, similar to ultrasound, radio-frequency/radar or sonar system, but each operates at speeds that differ from the others by orders of magnitude. A typical ultrasound detection system is analogous in concept to the phased-array radar systems on board commercial and military aircraft, and on military ships. Radar works in the GHz range, sonar in the kHz range, and ultrasound in the MHz range. Thus, other examples involving many sources and many receivers include the separation of radio or radar signals sensed by an array of antennas, sonar array signal processing, image deconvolution, radio astronomy, and signal decoding in cellular telecommunication systems. Those skilled in the signal processing arts will recognize the applicability of this process to solve blind source separation problems because of its broad application to many communication fields.

The composite signals are processed and separated into channels as shown in block 81. Preferably, the composite signals are separated into two channels: one having substantially only noise (noise-dominant) and one having noise plus informational components (combination). The separation may be accomplished, for example, by applying an independent component analysis, blind signal source, or an adaptive filter process to the composite signals. The process 75 must then identify which of the two channels is the noise-dominant channel, and which is the noise+information channel, as shown in block 83. The identification process may use one or more techniques to identify the channels. First, in some applications, it will be known in advance which transducer will be closest to the information sound source. In this case, it can be predetermined which channel will be mostly noise and which will be a combination of noise and information. If the relationship of the transducer to the sound source is less certain, then the identification will depend on signals generated in the process 75. In one example, the signal on one or both of the channels is evaluated to determine which channel is more likely to be the combination signal. In another example, the output signal 87 from process 75 is applied to another application, and that application is monitored to determine which of the channels, when used as the combination signal, provides the better application performance.

With the noise-dominant channel and the combination channel identified, the channels are processed to generate an informational signal. More particularly, the noise-dominant signal is applied to an adaptive filter arrangement to remove the noise components from the combination signal. Because the noise-dominant signal accurately represents the noise in the environment, the noise can be substantially removed from the combination signal, thereby providing a high quality informational signal. Finite impulse and infinite impulse filter topologies have been found to perform particularly well. However, it will be understood that the specific adaptive filter topology may be selected according to application requirements. For example, high pass, low pass, and band pass filter arrangements may be used depending on the type of informational signal and the expected noise sources in an acoustic environment.

Figure 4:
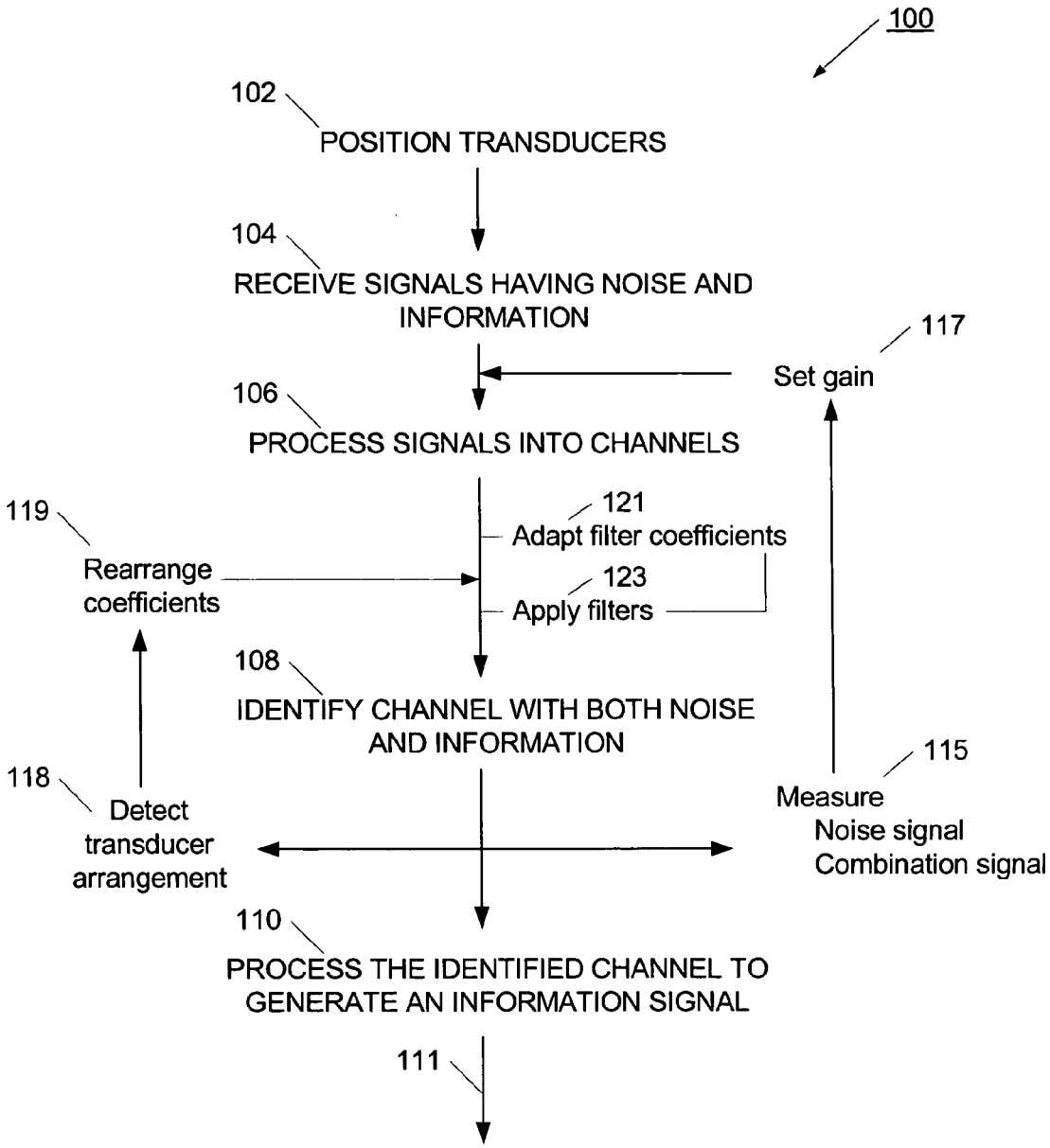
FIG. 4 is a flowchart of a separation process in accordance with the present invention.

Referring now to FIG. 4, another separation process 100 is illustrated. Separation process 100 is similar to separation process 75 discussed with reference to FIG. 3, and so will not be discussed in detail. Process 100 positions transducers to receive acoustic information and noise, and generate composite signals for further processing as shown in blocks 102 and 104. The composite signals are processed into channels as shown in block 106. Often, process 106 includes a set of filters with adaptive filter coefficients. For example, if process 106 uses an ICA process, then process 106 has several filters, each having an adaptable and adjustable filter coefficient. As the process 106 operates, the coefficients are adjusted to improve separation performance, as shown in block 121, and the new coefficients are applied and used in the filter as shown in block 123. This continual adaptation of the filter coefficients enables the process 106 to provide a sufficient level of separation, even in a changing acoustic environment.

The process 106 typically generates two channels, which are identified in block 108. Specifically, one channel is identified as a noise-dominant signal, while the other channel is identified as a combination of noise and information. As shown in block 115, the noise-dominant signal or the combination signal can be measured to detect a level of signal separation. For example, the noise-dominant signal can be measured to detect a level of speech component, and responsive to the measurement, the gain of microphone may be adjusted. This measurement and adjustment may be performed during operation of the process 100, or may be performed during set-up for the process. In this way, desirable gain factors may be selected and predefined for the process in the design, testing, or manufacturing process, thereby relieving the process 100 from performing these measurements and settings during operation. Also, the proper setting of gain may benefit from the use of sophisticated electronic test equipment, such as high-speed digital oscilloscopes, which are most efficiently used in the design, testing, or manufacturing phases. It will be understood that initial gain settings may be made in the design, testing, or manufacturing phases, and additional tuning of the gain settings may be made during live operation of the process 100.

Some devices using process 100 may allow for more than one transducer arrangement, but the alternative arrangements may have a complementing or other known relationship. For example, a wireless mobile device may have two microphones, each located at a lower corner of the phone housing. If the phone is held in a user's right hand, one microphone may close to the user's mouth while the other is positioned more distant, but when the user switches hands, and the phone is held in the user's left hand, then the microphones change positions. That is, the microphone that was close to the mouth is now more distant, and the microphone that was more distant is now close to the user's mouth. Even though the absolute microphone positions have changed, the relative relationship remains quite constant. Such a symmetrical arrangement may be advantageously used to more efficiently adapt the process 100 when the transducer arrangement is changed.

Take, for example, a device having two possible microphone arrangements, with the two arrangements having a known relationship, such as being symmetrical and complementary as described above. When the device is operated in the first arrangement, the process 100 adapts and applies filter coefficients to the separation process 106. When the process 100 detects that the device has been moved to the second arrangement, as shown in block 118, then the process 100 may simply rearrange the coefficients to accommodate the new arrangement. In this way, the separation process 106 quickly adapts to the new arrangement. Since there is a known relationship between filter coefficients in each of the two positions, once the coefficients are determined in one arrangement, the same coefficients provide good initial coefficients when the device is moved to the second arrangement. A change in transducer arrangement may be detected, for example, by monitoring the energy or SNR in the separated channels. Alternatively, a external sensor may be used to detect the position of the transducers.

With the noise-dominant channel and the combination channel identified, the channels are processed to generate an informational signal. More particularly, the noise-dominant signal is applied to an adaptive filter arrangement to remove the noise components from the combination signal. Because the noise-dominant signal accurately represents the noise in the environment, the noise can be substantially removed from the combination signal, thereby providing a high quality informational signal. Finite impulse and infinite impulse filter topologies have been found to perform particularly well. However, it will be understood that the specific adaptive filter topology may be selected according to application requirements. For example, high pass, low pass, and band pass filter arrangements may be used depending on the type of informational signal and the expected noise sources in an acoustic environment.

Figure 5:
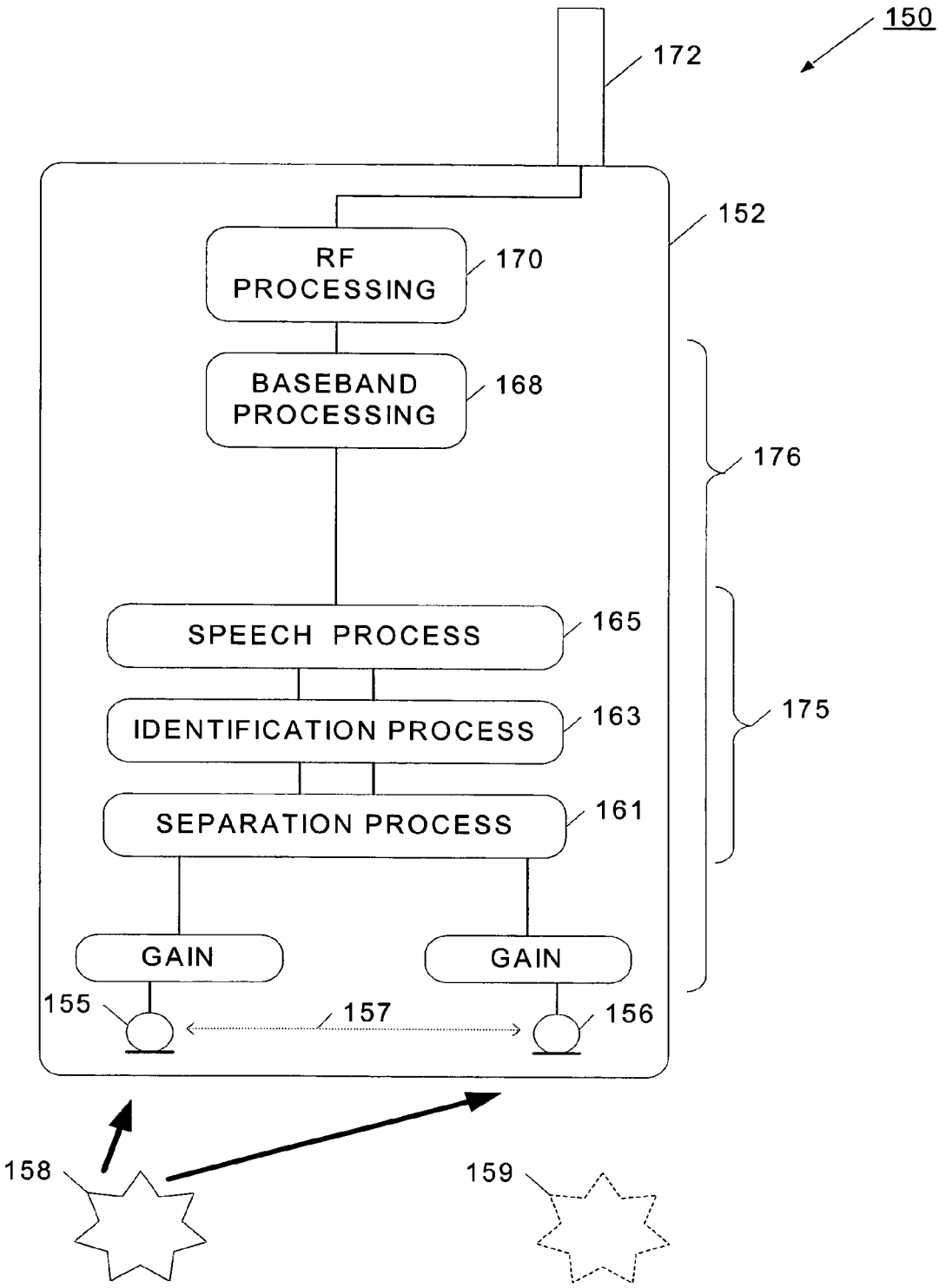
FIG. 5 is a block diagram of a wireless mobile device using a separation process in accordance with the present invention.

Referring now to FIG. 5, a wireless device is illustrated. Wireless device 150 is constructed to operate a separation process such as separation process 75 discussed with reference to FIG. 3. Wireless device 150 has a housing 152 that is sized to be held in the hand of user. The housing may be in the traditional "candybar" rectangular shape, where the user always has access to the display, keypad, microphone, and earpiece. Alternatively, the housing may be in the "clamshell" flip-phone shape, where the phone is in two hinged portions. In the flip-phone, the user opens the housing to access the display, keypad, microphone, and earpiece. It will be understood that other physical arrangements may used for the housing. Also, although the wireless device is illustrated as a wireless handset, it will be understood that the wireless device may be in the form of a personal data assistant, a hands-free car kit, a walkie-talkie, a commercial-band radio, a portable telephone handset, or other portable device that enables a user to verbally communicate over a wireless air interface.

Wireless device 150 has at least two microphones 155 and 156 mounted on the housing. Preferably, each microphone is positioned to permit a direct communication path to the speaker. A direct communication path exists if there are no physical obstructions between the speaker's mouth and the microphones. As illustrated, microphone 155 is positioned at the lower left portion of the housing 152, with no obstructions to the speaker's mouth, which is identified by position 158. Microphone 156 is positioned at the lower right portion of the housing 152, with no obstructions to the speaker's mouth, so also has a direct path to position 158. Microphone 156 is spaced apart from microphone 155 by a distance 157. Such distance 157 is determined so that the input signals are not identical nor completely distinct in the two microphones, but comprises some overlap in the two signals. Distance 157 may be range of about 1 mm to about 100 mm, and is preferably in the range of about 10 mm to about 50 mm. The maximum distance on some wireless devices may be limited by the width of the device's housing. To increase the distance, one of the microphones may be place in an upper portion of the housing (provided it is place to avoid being covered by the user's hand), or may be placed on the back of the housing. When positioned on the back of the housing the second microphone would not have a direct path to the speaker, which may result in degraded separation performance as compared to having a direct path, but the distance between the microphones is greater, which may enhance separation performance. In this way, on some small devices, better overall separation performance may be obtained by increasing the distance 157, even if that results in placing the second microphone so that it does not have a direct path to the speaker.

In one example the gain of each microphone may be set using a gain setting process. The gain adjustment process may be performed in a laboratory environment during the design phase of the wireless device. During the gain adjustment process, electronic test equipment, such as a digital oscilloscope, is used to characterize the input and/or output of the separation process 161. As previously discussed, the separation process 161 generates two channels: one that is substantially noise, and another that is a combination of noise and speech. A noisy environment is simulated, and a speech source provides a speech input to the microphones. In one example, a designer connects the noise-dominant channel to the oscilloscope, and manually adjusts the gain(s) to minimize the level of speech that passes onto the noise-dominant signal. It will be understood that other test equipment and test plans may be used to adjust the gain(s) in setting a desired level of separation.

Once the desired gain level has been determined, the selected gain levels may be pre-defined for the wireless device 150. These gain settings may be fixed in the wireless device 150, or may be made adjustable. For example, the gain settings may be set by a factor stored in a non-volatile memory. In this way, the gain settings may be adjusted by changing the memory setting, for example, when the wireless device is programmed or when its operating software is updated. In another example, the gain settings may be adjusted responsive to measurements made by the wireless device during operation. In this way, the wireless device could dynamically adapt the gain setting(s) to obtain a desired level of separation.

Each of the microphones receives both noise and speech components, and generates a composite signal. The composite signal has an appropriate gain applied, and each composite signal is received into the separation process 161. The composite signals are preferably in the form of digital data in the separation process, thereby allowing efficient mathematical manipulation and filtering. Accordingly, the composite signals from the microphones are digitized by an analog to digital converter (not shown). Analog to digital conversion is well-known, so will not be discussed in detail.

Once the composite signals have been separated into two channels, the channels are identified in identification process 163. The identification process 163 identifies one of the channels as the noise-dominant channel, and the other channel as the combination channel. The speech process 165 accepts the channels, and uses the noise-dominant channel to set filter coefficients that are applied to the combination channel. Since the noise is accurately characterized in the noise-dominant signal, the coefficients may be efficiently set to obtain superior noise reduction in the combination signal. In this way, a good quality speech signal is provided to the baseband processing circuitry 168 and the radio frequency (RF) circuitry 170 for coding and modulation. The RF signal, having a modulated speech signal, is then wirelessly transmitted from antenna 172.

During the separation process, coefficients are adapted and set according to the environment and the speaker's voice. However, the user may start a conversation while holding the handset 150 in the left hand, and during the conversation, change to position the phone in the right hand. In such a case, the speaker's mouth has a first position 158, and a second position 159. More particularly, in position 158 microphone 155 is a close distance to the mouth, and microphone 156 is a greater distance from the mouth. In position 159, microphone 156 is now at about the close distance to the mouth, and microphone 155 is about the greater distance from the mouth. Accordingly, when the identification process 163 detects that the user has changed from position 158 to position 159, the separation process may rearrange the current filter coefficients. That is, when the position change is detected, the filter coefficients used on channel 1 are applied to channel 2 and the filter coefficients used on channel 2 are applied to channel 1. By swapping or rearranging coefficients, the separation process 161 is more efficiently able to adapt to the new position change.

In one example, the speech separation process 163 uses an independent component analysis (ICA) to perform its separation process. The ICA processing function uses simplified and improved ICA processing to achieve real-time speech separation with relatively low computing power. In applications that do not require real-time speech separation, the improved ICA processing can further reduce the requirement on computing power. As used herein, the terms ICA and BSS are interchangeable and refer to methods for minimizing or maximizing the mathematical formulation of mutual information directly or indirectly through approximations, including time- and frequency-domain based decorrelation methods such as time delay decorrelation or any other second or higher order statistics based decorrelation methods.

As used herein, a "module" or "sub-module" can refer to any method, apparatus, device, unit or computer-readable data storage medium that includes computer instructions in software, hardware or firmware form. It is to be understood that multiple modules or systems can be combined into one module or system and one module or system can be separated into multiple modules or systems to perform the same functions. When implemented in software or other computer-executable instructions, the elements of the ICA process are essentially the code segments to perform the necessary tasks, such as with routines, programs, objects, components, data structures, and the like. The program or code segments can be stored in a processor readable medium or transmitted by a computer data signal embodied in a carrier wave over a transmission medium or communication link. The "processor readable medium" may include any medium that can store or transfer information, including volatile, nonvolatile, removable and non-removable media. Examples of the processor readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet, Intranet, etc. In any case, the present invention should not be construed as limited by such embodiments.

The speech separation system is preferably incorporated into an electronic device that accepts speech input in order to control certain functions, or otherwise requires separation of desired noises from background noises, such as communication devices. Many applications require enhancing or separating clear desired sound from background sounds originating from multiple directions. Such applications include human-machine interfaces such as in electronic or computational devices which incorporate capabilities such as voice recognition and detection, speech enhancement and separation, voice-activated control, and the like. Due to the lower processing power required by the invention speech separation system, it is suitable in devices that only provide limited processing capabilities.

Figure 6:
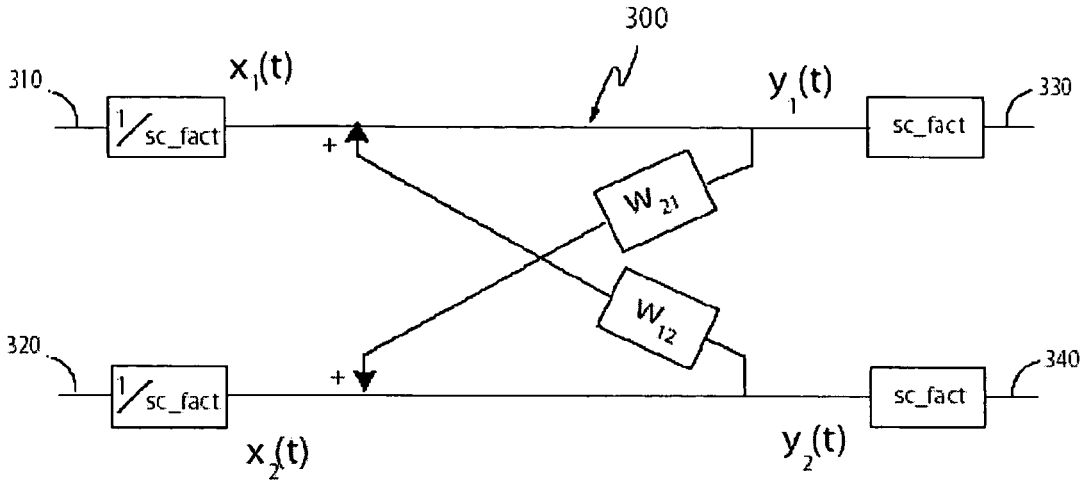
FIG. 6 is a block diagram of one embodiment of an improved ICA processing sub-module in accordance with the present invention.

FIG. 6 illustrates one embodiment 300 of an improved ICA or BSS processing function. Input signals $X_1$ and $X_2$ are received from channels 310 and 320, respectively. Typically, each of these signals would come from at least one microphone, but it will be appreciated other sources may be used. Cross filters $W_1$ and $W_2$ are applied to each of the input signals to produce a channel 330 of separated signals $U_1$ and a channel 340 of separated signals $U_2$. Channel 330 (speech channel) contains predominantly desired signals and channel 340 (noise channel) contains predominantly noise signals. It should be understood that although the terms "speech channel" and "noise channel" are used, the terms "speech" and "noise" are interchangeable based on desirability, e.g., it may be that one speech and/or noise is desirable over other speeches and/or noises. In addition, the method can also be used to separate the mixed noise signals from more than two sources.

Infinite impulse response filters are preferably used in the present processing process. An infinite impulse response filter is a filter whose output signal is fed back into the filter as at least a part of an input signal. A finite impulse response filter is a filter whose output signal is not feedback as input. The cross filters $W_{21}$ and $W_{12}$ can have sparsely distributed coefficients over time to capture a long period of time delays. In a most simplified form, the cross filters $W_{21}$ and $W_{12}$ are gain factors with only one filter coefficient per filter, for example a delay gain factor for the time delay between the output signal and the feedback input signal and an amplitude gain factor for amplifying the input signal. In other forms, the cross filters can each have dozens, hundreds or thousands of filter coefficients. As described below, the output signals $U_1$ and $U_2$ can be further processed by a post processing sub-module, a de-noising module or a speech feature extraction module.

Although the ICA learning rule has been explicitly derived to achieve blind source separation, its practical implementation to speech processing in an acoustic environment may lead to unstable behavior of the filtering scheme. To ensure stability of this system, the adaptation dynamics of $W_{12}$ and similarly $W_{21}$ have to be stable in the first place. The gain margin for such a system is low in general meaning that an increase in input gain, such as encountered with non stationary speech signals, can lead to instability and therefore exponential increase of weight coefficients. Since speech signals generally exhibit a sparse distribution with zero mean, the sign function will oscillate frequently in time and contribute to the unstable behavior. Finally since a large learning parameter is desired for fast convergence, there is an inherent trade-off between stability and performance since a large input gain will make the system more unstable. The known learning rule not only lead to instability, but also tend to oscillate due to the nonlinear sign function, especially when approaching the stability limit, leading to reverberation of the filtered output signals $Y_1[t]$ and $Y_2[t]$. To address these issues, the adaptation rules for $W_{12}$ and $W_{21}$ need to be stabilized. If the learning rules for the filter coefficients are stable, extensive analytical and empirical studies have shown that systems are stable in the BIBO (bounded input bounded output). The final corresponding objective of the overall processing scheme will thus be blind source separation of noisy speech signals under stability constraints.

The principal way to ensure stability is therefore to scale the input appropriately as illustrated by FIG. 6. In this framework the scaling factor sc_fact is adapted based on the incoming input signal characteristics. For example, if the input is too high, this will lead to an increase in sc_fact, thus reducing the input amplitude. There is a compromise between performance and stability. Scaling the input down by sc_fact reduces the SNR which leads to diminished separation performance. The input should thus only be scaled to a degree necessary to ensure stability. Additional stabilizing can be achieved for the cross filters by running a filter architecture that accounts for short term fluctuation in weight coefficients at every sample, thereby avoiding associated reverberation. This adaptation rule filter can be viewed as time domain smoothing. Further filter smoothing can be performed in the frequency domain to enforce coherence of the converged separating filter over neighboring frequency bins. This can be conveniently done by zero tapping the K-tap filter to length L, then Fourier transforming this filter with increased time support followed by Inverse Transforming. Since the filter has effectively been windowed with a rectangular time domain window, it is correspondingly smoothed by a sinc function in the frequency domain. This frequency domain smoothing can be accomplished at regular time intervals to periodically reinitialize the adapted filter coefficients to a coherent solution.

The following equations are examples of nonlinear bounded functions that can be used for each time sample window of size t and with k being a time variable, $$U_1(t)=X_1(t)+W_{12}(t)X_2(t) \quad \text{(Eq. 1)}$$

$$U_2(t)=X_2(t)+W_{21}(t)X_1(t) \quad \text{(Eq. 2)}$$

$$Y1=\text{sign}(U1) \quad \text{(Eq. 3)}$$

$$Y2=\text{sign}(U2) \quad \text{(Eq. 4)}$$

$$\Delta W_{12k}=-f(Y_1)\times U_2[t-k] \quad \text{(Eq. 5)}$$

$$\Delta W_{21k}=-f(Y_2)\times U_1[t-k] \quad \text{(Eq. 6)}$$

The function f(x) is a nonlinear bounded function, namely a nonlinear function with a predetermined maximum value and a predetermined minimum value. Preferably, f(x) is a nonlinear bounded function which quickly approaches the maximum value or the minimum value depending on the sign of the variable x. For example, Eq. 3 and Eq. 4 above use a sign function as a simple bounded function. A sign function f(x) is a function with binary values of 1 or −1 depending on whether x is positive or negative. Example nonlinear bounded functions include, but are not limited to:

$$f(x)=\text{sign}(x)=\left\{\begin{array}{c|c} 1 & x>0 \\ -1 & x\le 0 \end{array}\right\} \quad \text{(Eq. 7)}$$

$$f(x)=\tanh(x)=\frac{e^x-e^{-x}}{e^x+e^{-x}} \quad \text{(Eq. 8)}$$

$$f(x)=\text{simple}(x)=\left\{\begin{array}{c|c} 1 & x\ge\varepsilon \\ x/\varepsilon & -\varepsilon>x>\varepsilon \\ -1 & x\le-\varepsilon \end{array}\right\} \quad \text{(Eq. 9)}$$

These rules assume that floating point precision is available to perform the necessary computations. Although floating point precision is preferred, fixed point arithmetic may be employed as well, more particularly as it applies to devices with minimized computational processing capabilities. Notwithstanding the capability to employ fixed point arithmetic, convergence to the optimal ICA solution is more difficult. Indeed the ICA algorithm is based on the principle that the interfering source has to be cancelled out. Because of certain inaccuracies of fixed point arithmetic in situations when almost equal numbers are subtracted (or very different numbers are added), the ICA algorithm may show less than optimal convergence properties.

Another factor which may affect separation performance is the filter coefficient quantization error effect. Because of the limited filter coefficient resolution, adaptation of filter coefficients will yield gradual additional separation improvements at a certain point and thus a consideration in determining convergence properties. The quantization error effect depends on a number of factors but is mainly a function of the filter length and the bit resolution used. The input scaling issues listed previously are also necessary in finite precision computations where they prevent numerical overflow. Because the convolutions involved in the filtering process could potentially add up to numbers larger than the available resolution range, the scaling factor has to ensure the filter input is sufficiently small to prevent this from happening.

The present processing function receives input signals from at least two audio input channels, such as microphones. The number of audio input channels can be increased beyond the minimum of two channels. As the number of input channels increases, speech separation quality may improve, generally to the point where the number of input channels equals the number of audio signal sources. For example, if the sources of the input audio signals include a speaker, a background speaker, a background music source, and a general background noise produced by distant road noise and wind noise, then a four-channel speech separation system will normally outperform a two-channel system. Of course, as more input channels are used, more filters and more computing power are required. Alternatively, less than the total number of sources can be implemented, so long as there is a channel for the desired separated signal(s) and the noise generally.

The present processing sub-module and process can be used to separate more than two channels of input signals. For example, in a cellular phone application, one channel may contain substantially desired speech signal, another channel may contain substantially noise signals from one noise source, and another channel may contain substantially audio signals from another noise source. For example, in a multi-user environment, one channel may include speech predominantly from one target user, while another channel may include speech predominantly from a different target user. A third channel may include noise, and be useful for further process the two speech channels. It will be appreciated that additional speech or target channels may be useful.

Although some applications involve only one source of desired speech signals, in other applications there may be multiple sources of desired speech signals. For example, teleconference applications or audio surveillance applications may require separating the speech signals of multiple speakers from background noise and from each other. The present process can be used to not only separate one source of speech signals from background noise, but also to separate one speaker's speech signals from another speaker's speech signals. The present invention will accommodate multiple sources so long as at least one microphone has in a direct path with the speaker.

Figure 7:
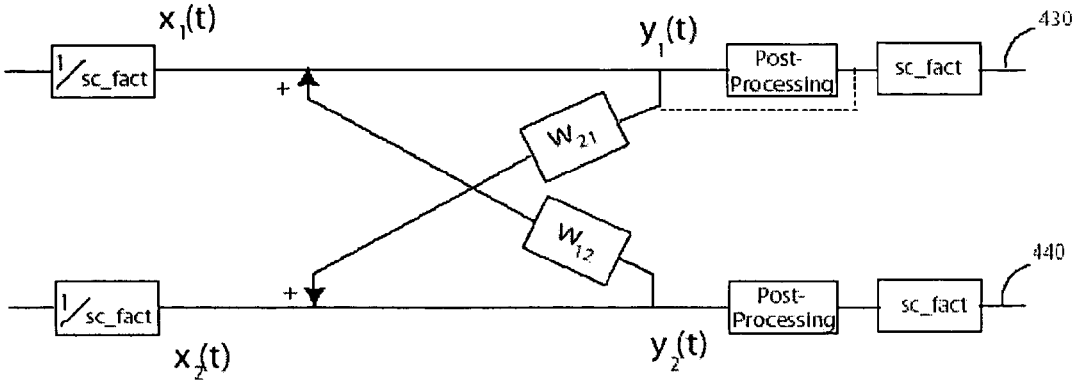
FIG. 7 is a block diagram of one embodiment of an improved ICA speech separation process in accordance with the present invention.

The present process separates sound signals into at least two channels, for example one channel dominated with noise signals (noise-dominant channel) and one channel for speech and noise signals (combination channel). As shown in FIG. 7, channel 430 is the combination channel and channel 440 is the noise-dominant channel. It is quite possible that the noise-dominant channel still contains some low level of speech signals. For example, if there are more than two significant sound sources and only two microphones, or if the two microphones are located close together but the sound sources are located far apart, then processing alone might not always fully separate the noise. The processed signals therefore may need additional speech processing to remove remaining levels of background noise and/or to further improve the quality of the speech signals. This is achieved by feeding the separated outputs through a single or multi channel speech enhancement algorithm, for example, a Wiener filter with the noise spectrum estimated using the noise-dominant output channel (a VAD is not typically needed as the second channel is noise-dominant only). The Wiener filter may also use non-speech time intervals detected with a voice activity detector to achieve better SNR for signals degraded by background noise with long time support. In addition, the bounded functions are only simplified approximations to the joint entropy calculations, and might not always reduce the signals' information redundancy completely. Therefore, after signals are separated using the present separation process, post processing may be performed to further improve the quality of the speech signals.

Based on the reasonable assumption that the noise signals in the noise-dominant channel have similar signal signatures as the noise signals in the combination channel, those noise signals in the combination channel whose signatures are similar to the signatures of the noise-dominant channel signals should be filtered out in the speech processing functions. For example, spectral subtraction techniques can be used to perform such processing. The signatures of the signals in the noise channel are identified. Compared to prior art noise filters that relay on predetermined assumptions of noise characteristics, the speech processing is more flexible because it analyzes the noise signature of the particular environment and removes noise signals that represent the particular environment. It is therefore less likely to be over-inclusive or under-inclusive in noise removal. Other filtering techniques such as Wiener filtering and Kalman filtering can also be used to perform speech post-processing. Since the ICA filter solution will only converge to a limit cycle of the true solution, the filter coefficients will keep on adapting without resulting in better separation performance. Some coefficients have been observed to drift to their resolution limits. Therefore a post-processed version of the ICA output containing the desired speaker signal is fed back through the IIR feedback structure as illustrated the convergence limit cycle is overcome and not destabilizing the ICA algorithm. A beneficial byproduct of this procedure is that convergence is accelerated considerably.

Figure 8:
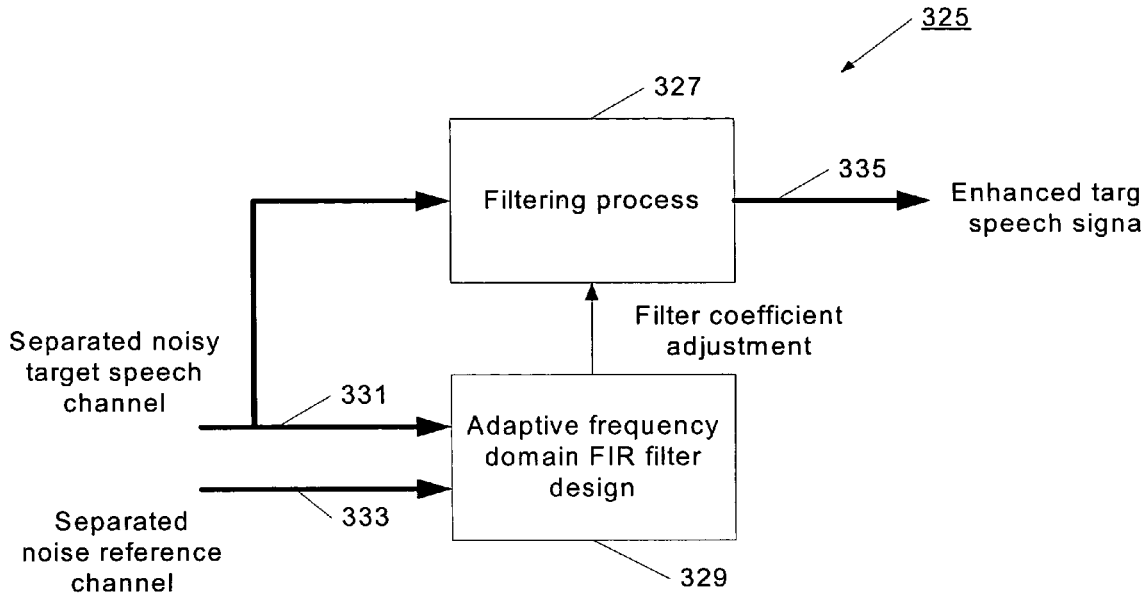
FIG. 8 is a block diagram of a de-noising processing in accordance with the present invention.

FIG. 8 shows one example of a post-processing process 325. The process 325 has an adaptive filter 329 that accepts both a noise-dominate signal 333 and a combination signal 331. As described more fully above, the adaptive filter329 uses the signals to adapt filtering factors or coefficients. The adaptive filter provides these factors or coefficients to a filter 327. The filter 327 applies the adapted coefficients to the combination signal 331 to generate an enhanced speech signal 335.

Another application of the present process is to cancel out acoustic noise, including echoes. Since the separation module includes adaptive filters it can remove time-delayed source signals as well as its echoes. Removing echoes is known as deconvolving a measured signal such that the resulting signal is free of echoes. The present process may therefore acts as a multichannel blind deconvolution system. The term blind refers to the fact that the reference signal or signal of interest is not available. In many echo cancellation applications however, a reference signal is available and therefore blind signal separation techniques should be modified to work in those situations. In a handheld phone application for example, a speech signal is transmitted to another phone where the speech signal is picked up by the microphone on the receiving end. In a full duplex transmission mode, the recorded speech on the receiver end is transmitted to the transmitter, and if the echo is not canceled, the transmitter will be able to hear the echo. Echo cancellation systems may be based on LMS (least mean squared) techniques in which a filter is adapted based on the error between the desired signal and filtered signal. For echo cancellation, the present process need not be based on LMS but on the principle of minimizing the mutual information. Therefore, the derived adaptation rule for changing the value of the coefficients of the echo canceling filter is different. The implementation of an echo canceller is comprises the following steps: (i) the system requires at least one microphone and assumes that at least one reference signal is known; (2) the mathematical model for filtering and adaptation are similar to the equations in 1 to 6 except that the function f is applied to the reference signal and not to the output of the separation module; (3) the function form of f can range from linear to nonlinear; and (4) prior knowledge on the specific knowledge of the application can be incorporated into a parametric form of f. It will be appreciated that know methods and algorithms may be then used to complete the echo cancellation process. Other echo cancellation implementation methods include the use of the Transform Domain Adaptive Filtering (TDAF) techniques to improve technical properties of the echo canceller.

While particular preferred and alternative embodiments of the present intention have been disclosed, it will be appreciated that many various modifications and extensions of the above described technology may be implemented using the teaching of this invention. All such modifications and extensions are intended to be included within the true spirit and scope of the appended claims.

What is claimed is:

1. A speech separation process, comprising:

positioning a plurality of microphones with respect to a speech source so that each respective microphone generates a signal having a speech component and a noise component in different mixing ratios;

receiving each of the signals generated by the microphones into a separation process;

separating the received signals into a first channel and a second channel, one of the channels providing a noise signal that is substantially noise components and the other channel providing a combination signal that is a combination of noise components and speech components;

identifying which of the first or second channels has the combination signal;

processing the combination signal with the noise signal;

generating a speech signal indicative of the speech from the speech source;

positioning the plurality of microphones in a first arrangement where a first microphone is closer to the speech source and a second microphone is farther from the speech source;

providing a set of filters within the separation process;

setting, for the first arrangement, each of the filters with respective filter coefficients to facilitate channel separation;

positioning the plurality of microphones in a second arrangement where the second microphone is closer to the speech source and the first microphone is farther from the speech source; and rearranging, for the second arrangement, the filter coefficients for the set of filters.

2. The speech separation process according to claim 1, further including:

detecting a change from the first arrangement to the second arrangement.

3. The speech separation process according to claim 2 wherein the detecting step further includes making an energy comparison using one of the signals generated by the microphones.

4. The speech separation process according to claim 2 wherein the detecting step further includes making an energy comparison using the signals generated by the microphones to rearrange the filter coefficients.

5. The speech separation process according to claim 2 wherein the detecting step further includes using a-prior knowledge of the speech source location or characteristic.

* * * * *